United States Patent [19]

Kopp

[11] Patent Number: 4,516,769

[45] Date of Patent: May 14, 1985

[54] REBOUND SPORTS TRAINING APPARATUS

[76] Inventor: Harold W. Kopp, 137 Daytona Ave., Narragansett, R.I. 02882

[21] Appl. No.: 588,288

[22] Filed: Mar. 12, 1984

[51] Int. Cl.[3] ..... A63B 69/00

[52] U.S. Cl. ..... 273/1 B; 273/411

[58] Field of Search ..... 273/411, 1 B; 272/76

[56] References Cited

U.S. PATENT DOCUMENTS 3,955,815 5/1976 Deschesnes ..... 273/1 B
4,070,017 1/1978 Lombardi ..... 273/1 B

FOREIGN PATENT DOCUMENTS 838470 6/1960 United Kingdom ..... 273/411

*Primary Examiner*—William H. Grieb
*Attorney, Agent, or Firm*—Charles S. McGuire

[57] ABSTRACT

Apparatus for use by athletes for developing both manipulative skills and muscular strength and endurance with respect to one or more particular sports involving forceful projection of a game object, such as a ball or puck, either directly by the player, e.g., by kicking, or through another game implement, e.g., a hockey or field hockey stick. The apparatus includes a stationary base structure including a hollow, tubular, sleeve. A first, hollow, slide member is mounted for reciprocal, linear movement through the fixed sleeve of the base structure, and a second slide member is mounted with one end inside and the other outside the first slide member for reciprocal, coaxial, linear movement with respect to and together with the first slide member. The game object is affixed by appropriate means to the outer end of the second slide member, and stop means are provided to limit movement in both directions of both slide members. A propelling force is imparted to the game object by the trainee, e.g., by kicking or striking, along the direction of linear movement of the slide members. When both members reach the forward limits of their sliding movement, a return force is provided by an elastic member connected between the first slide member and the fixed base structure. The sequence may be repeated at a rapid pace, thereby developing both the manipulative skills and the particular muscles used in imparting the propelling force to the game object.

9 Claims, 4 Drawing Figures

REBOUND SPORTS TRAINING APPARATUS

BACKGROUND OF THE INVENTION

The present invention relates to sports training apparatus and, more specifically, to rebound-type training devices for use in connection with sports wherein a game object is forcefully propelled by the players.

In a number of currently popular sports a game object is forcefully propelled into, or through, a goal structure for scoring, or for passing to other players, requiring not only accuracy but quickness and strength in imparting a forceful blow to the object. Examples of such sports, contemplated for principal applications of the present invention, are ice and field hockey, wherein a puck or ball is propelled into a goal with a stick manipulated by the player, soccer and field goal kicking in football. Although general body strength and endurance are, of course, necessary in such sports, certain specific muscles or muscle groups, which may vary from one sport to another, are primarily employed in imparting the propelling force to the game object.

In conventional sports conditioning, athletes engage in various exercises, either with or without the use of weights or other exercise apparatus, designed to strengthen the muscles of primary importance in a particular sport. Also, the athletes practise making kicks or shots of the game object to increase their manipulative skills while at the same time strengthening the muscles so used. It is difficult, however, to achieve a rapid and sustained repetition of practise shots or kicks, which is desireable for training purposes, since the ball or puck must be retrieved or replaced after it is propelled by the trainee.

It is a principal object of the present invention to provide novel and improved apparatus for training athletes in sports which involve propelling a game object into or through a goal structure.

A further object is to provide sports training apparatus which may be easily adapted for use in practising a number of different sports. Another object is to provide apparatus for training athletes in a sport involving propelling a game object wherein optimum conditioning is provided for the muscles or muscle groups primarily used in imparting such propelling movement while at the same time improving manipulative skills by striking or kicking the actual game object in substantially the same manner as in a game.

A still further object is to provide rebound sports training equipment wherein a game object attached to the equipment is quickly and automatically returned to its original position after being struck or kicked by a trainee, permitting rapid and sustained repetition propelling blows to the game object, exercising the necessary muscle groups in a manner closely simulating actual game conditions.

Still another object is to provide a sports training aid adapted for repeated, forceful blows on a game object which is of extremely durable and structurally sound design.

Other objects will in part be obvious and will in part appear hereinafter.

SUMMARY OF THE INVENTION

In furtherance of the foregoing objects, the invention contemplates sports training apparatus having a base support structure including a flat metal plate with suppot brackets welded or otherwise attached thereto and holding an elongated, hollow sleeve, open at both ends, in fixed position. A first slide member extends loosely through the fixed sleeve for reciprocal, sliding movement with respect thereto. Stop means such as peripheral flanges are affixed to the first slide member to limit its movement in both directions through the sleeve.

A second slide member, such as a solid bar or rod extends into one end of the first slide member for reciprocal, sliding movement, limited in the forward direction by a peripheral flange or bumper, and in the return direction by a fixed pin extending from the second slide member through an elongated slot in the first. The game object to which the propelling force is applied during the training, which is the same object used in the game for which the training is undertaken, e.g., a hockey puck, ball, etc., is fixedly attached by appropriate means to the outer end of the second slide member.

In operation, with both the first and second slide members at the outer positions of their travel, the operator or trainee applies a blow to the game object in substantially the same manner and with the same motion as in actual game conditions. For example, a standard hockey stick is used to strike the puck, a conventional soccer ball is kicked, etc. The second slide member travels within the first until reaching the inner limit of its travel, where contact of the stop means with the second slide member carries the latter toward the forward end of its movement. A heavy elastic cord is attached at one end to the first slide member and at the opposite end to a fixed portion of the base structure. The elastic cord is stretched as the first slide member is moved to its forward position and contracts to cause the first slide member to rebound to its outer or initial position. When outward movement of the first slide member is abruptly stopped by contact of the stop means with the fixed sleeve, the momentum of the second slide member will continue its outward movement until the pin thereon contacts the end of the elongated slot in the first slide member.

Thus, the elements are returned to their original positions by the resilient rebound action provided by the elastic cord. Also, the outward movement of the second slide member prevents any significant forward rebound of the first slide member as the stop means thereon forcefully strikes the fixed base structure. The rebound action is extremely quick and repeated propelling forces may be applied to the game object virtually as fast as the trainee is able to apply the blows thereto.

DETAILED DESCRIPTION

Figure 1:
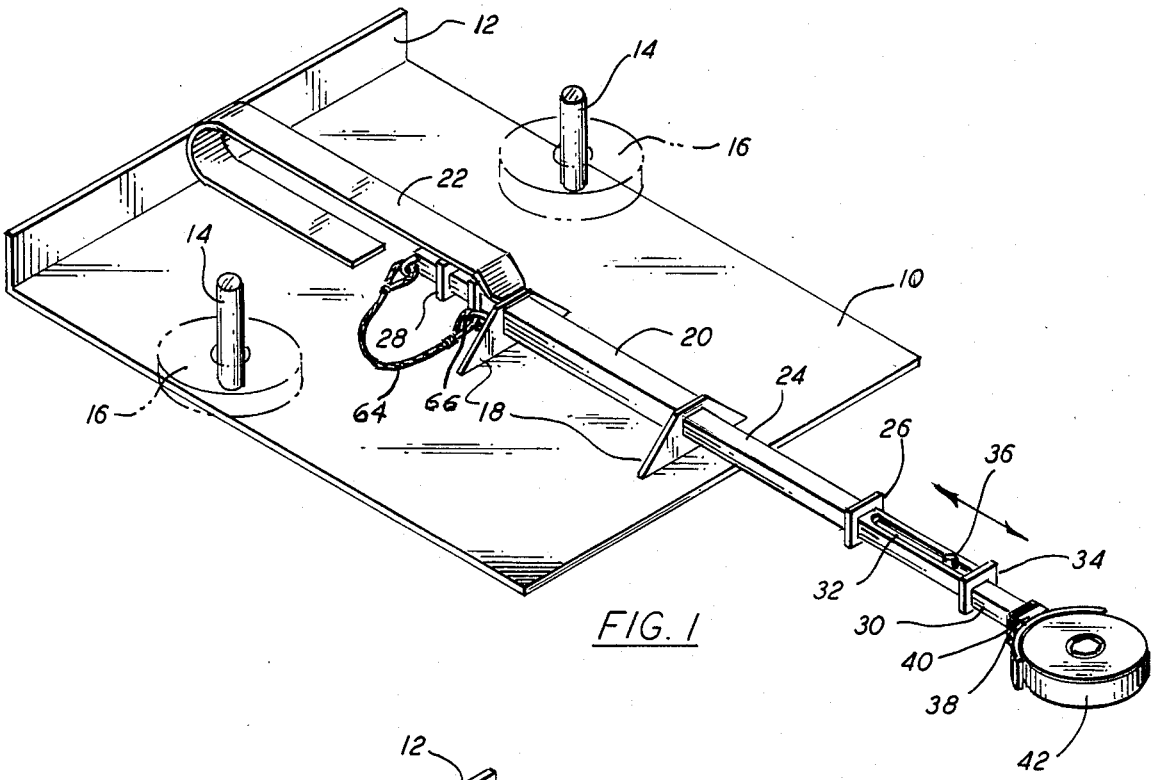
FIG. 1 is a perspective view of the preferred embodiment of the invention, showing certain movable elements in a first relative position.

Referring now to the drawings, the training apparatus of the invention includes a base support structure having a flat, rectangular, metal plate 10, intended to rest on a floor or other substantially horizontal support surface while the apparatus is in use in its principal anticipated applications. Upturned lip or flange 12 along one edge of plate 10 may be placed against a wall or other vertical object to assist in immobilizing the apparatus during use. Alternatively, or in addition to placing the apparatus against a vertical support, posts 14 may be affixed to plate 10, extending upwardly therefrom for accepting weights with central openings as shown in phantom lines in FIGS. 1 and 2 and indicated by reference numeral 16. The immovable or fixed portions of the base structure further include support brackets 18, welded or otherwise affixed to plate 10 to hold hollow, elongated sleeve 20. Additional support and structural stability, as well as protection against damage, is provided by curved support member 22.

Figure 3:
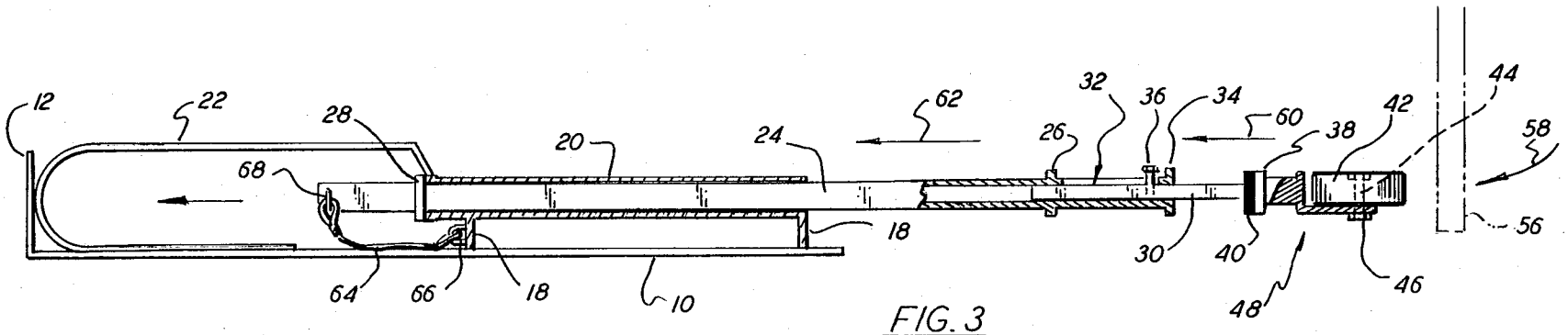
FIG. 3 is a side elevational view, partly in section, of the apparatus of FIGS. 1 and 2.

First slide member 24 extends loosely through sleeve 20 for freely sliding movement in both directions, limited by peripheral flanges 26 and 28 on slide member 24 contacting the opposite ends of sleeve 20, or by other appropriate stop means. First slide member 24 is a hollow, tubular structure, as best seen in FIG. 3, and second slide member 30 extends coaxially into the first slide member for free, reciprocal, sliding movement with respect thereto. In the form illustrated, sleeve 20 and first slide member 24 are of hollow, square cross section, and second slide member 30 is a solid rod or bar, also of square cross section, in order to prevent relative rotation of these members, although other configurations could be employed which provide the reciprocal telescoping action while restraining rotational movement.

Elongated slot 32 is formed in the upper wall of first slide member 24 between peripheral flange 26, which provides the stop means for forward movement, and peripheral flange 34 at the outer terminal end. Pin 36 extends through slot 32 and is threaded into or otherwise affixed to second slide member 30. Fixed stop means in the form of peripheral flange 38, with resilient plastic or rubber bumper 40 attached thereto, is provided on the outer end of second slide member 30. The term game object, in the sense of the present application, denotes a ball, puck, or the like, of the type used in an actual game for which training is undertaken on the apparatus of the invention, and is secured directly to the outer, terminal end of second slide member 30 by appropriate attachment structure.

Figure 2:
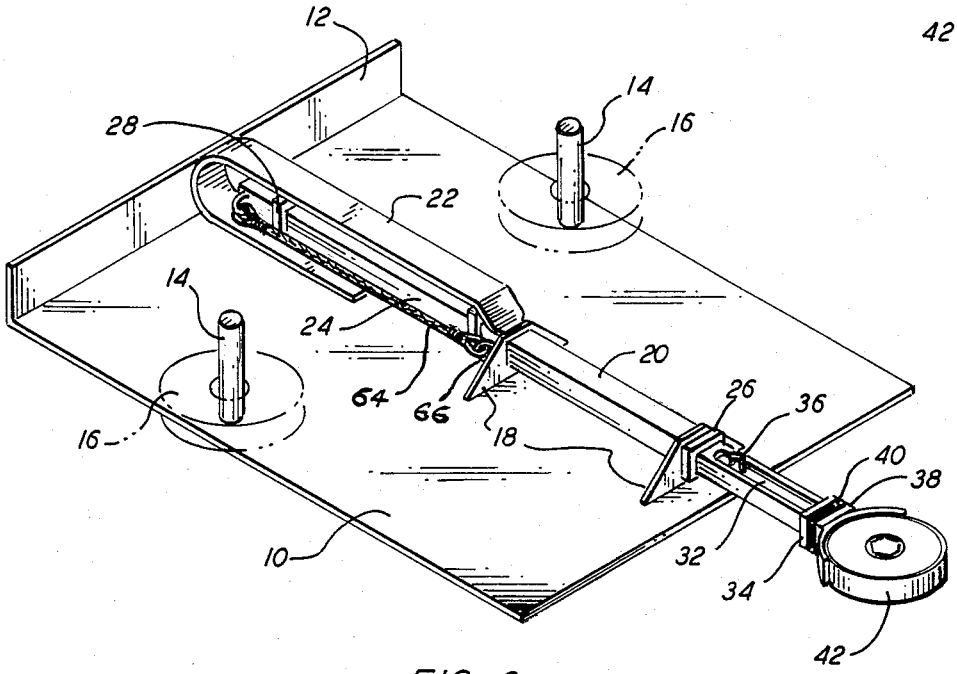
FIG. 2 is a perspective view of the same apparatus as FIG. 1, with the elements in a second position.
Figure 4:
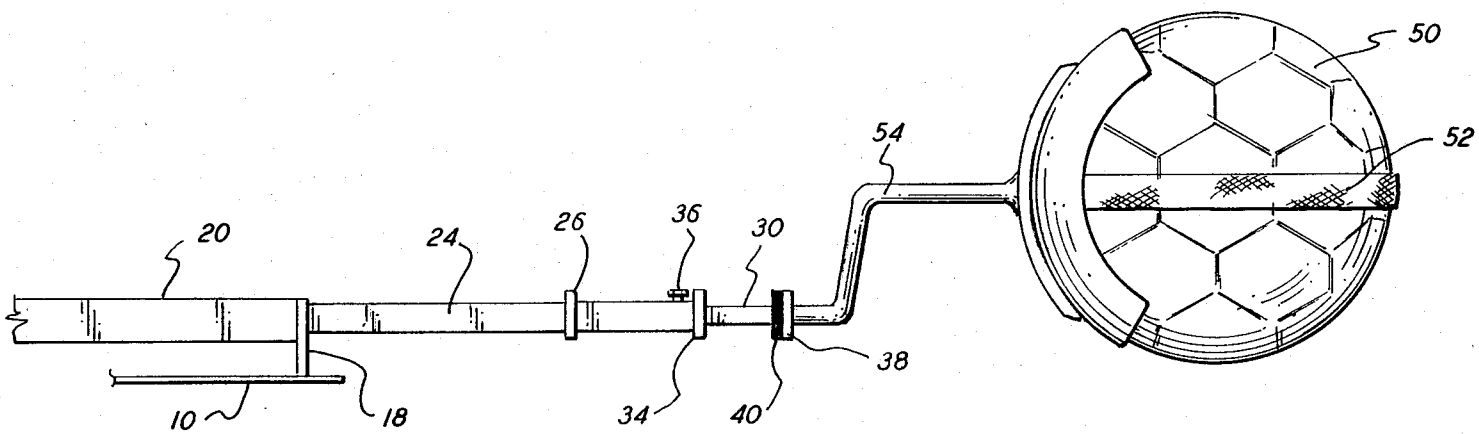
FIG. 4 is a fragmentary, side elevational view of the forward portion of the apparatus showing a different game object attached thereto from that shown in FIGS. 1–3.

The attachment structure is adapted to the particular game object which is used on the training apparatus. For example, as shown in FIGS. 1–3, the game object is a conventional ice hockey puck 42, drilled through the center for attachment by a bolt 44 and nut 46 to attachment structure 48. The game object of FIG. 4 is a soccer ball 50, secured by elastic band 52 mating support structure including offset neck 54, the apparatus being otherwise the same as in FIGS. 1–3. The game object support structure may be permanently attached to the outer end of second slide member 30, if the apparatus is to be used for training in sport using a specific game object, but is preferably removable and easily replaced with support structure for a different game object. It is also possible, of course, to design support structure capable of mounting more than one particular game object.

In operation, with the game object attached to the outer end of second slide member 30 and the two slide members positioned at or near the outer or rearward limits of their movement, as shown in FIG. 1, the operator or trainee applies a blow to the game object. In the case of hockey puck 42, the blow is applied with a standard hockey stick, a fragment of which is indicated in phantom lines in FIG. 3, denoted by reference numeral 56. The stick motion and force applied to the puck closely simulate actual game conditions and are performed with the same physical movements, thereby using the same muscles and muscle groups employed in making shots on goal and passes of the puck.

Referring still to FIG. 3, movement of stick 56 in a horizontal direction or in an arcuate path, as indicated by arrow 58, to contact puck 42 imparts movement to second slide member 30 in the forward direction indicated by arrow 60. Although forward motion of second slide member may be limited by contact of pin 36 with the end of slot 32, it is preferred that the aforementioned stop means, peripheral flange 38 and rubber bumper 40, contact peripheral flange 34 on first slide member 24 before pin 36 reaches the end of slot 32 in order to minimize the possibility of damage. When second slide member 30 reaches the forward limit of its travel, its momentum is transmitted to first slide member 24 which then moves in the forward direction indicated by arrow 62.

Elastic cord 64 is attached at one end to loop 66 on fixed support bracket 18 and at the other end to loop 68 on the forward end of first slide member 24. Cord 64 is thus stretched by forward movement of first slide member 24, to an extent determined by the momentum transferred thereto and the degree of stiffness or resiliency of the cord. The maximum amount of forward movement of first slide member 24 is limited by contact of peripheral flange 26 with the portion of support bracket 18 surrounding the rear end of fixed sleeve 20, in the position shown in FIG. 2. Cord 64 contracts after being stretched to provide a rebound force moving first slide member 24 back in a rearward direction, which continues until peripheral flange 28 contacts the forward end of sleeve 20.

When rearward movement of first slide member 24 is abruptly stopped, inertial forces continue movement of second slide member 30 which slides within member 24 until pin 36 contacts the end of slot 32. The continued movement of the second slide member, and impact of pin 36 with the end of slot 32 helps to prevent any significant rebound of first slide member 24 back in the forward direction due to impact of peripheral flange 28 with the forward end of fixed sleeve 20. Rubber bumpers (not shown) may be provided on flanges 26 and 28 to cushion the impact thereof with the ends of sleeve 20, in the manner of bumper 40 on flange 38.

The training apparatus of the invention offers the trainee an opportunity to make a sustained series of blows to a game object in rapid succession in a manner closely simulating actual game conditions. Whether the game object be a hockey puck, struck by the trainee with a standard hockey stick, or a soccer ball, kicked by the trainee, the muscles exercised and conditioned are those utilized in making the same type of shots of the game object in the game for which training is undertaken. Also, the same movements of the hands and arms, or legs and feet, used in propelling the game object in actual game conditions are repeatedly rehearsed and thus reinforced. For example, use of the training apparatus to strike a puck or ball with an ice or field hockey stick has been found extremely useful in developing strong slap-shot and wrist roll techniques. With the automatic rebound action bringing the game object back to its original position in a fraction of a second after being struck, the practise sequence may be repeated at a very rapid pace, aiding in the training and conditioning process. By using the two slide members, the initial motion is imparted to the game object without resistance from the biasing means used to provide the rebound action. Instead of the illustrated elastic cord, a spring or other such means may be utilized to provide the rebound action. Also, it is preferred that the means providing the rebound action by easily removed and replaced with elements providing different degrees of resilience, or otherwise be adjustable to vary the amount of force required to move the slide members to the full extent of their forward motion. Besides the hockey and soccer applications illustrated, it is also contemplated that the apparatus may be utilized in football field goal kicking training, with the forward end elevated, if desired, to simulate upward travel of the ball.

What is claimed is:

1. Apparatus for training a player in sports involving the forceful projection of a game object, said apparatus comprising:

(a) stationary base structure;

(b) at least one member mounted for reciprocal motion between first and second positions with respect to said base structure said member including a first element mounted for reciprocal, sliding movement upon said base structure;

(c) a game object fixedly attached to one end of said member for application of a propelling force by a player, thereby moving said member from said first to said second position thereof;

(d) stretchable means connected between said base structure and said member for movement from a normally contracted to a flexed condition as said member is moved from said first to said second position thereof, whereby movement of said stretchable means back to said contracted position returns said member to said first position thereof and;

(e) a second element mounted for reciprocal, sliding movement upon said first element and movable therewith between said first and second positions.

2. The invention according to claim 1 wherein said game object comprises a hockey puck and said propelling force is applied by the player with a hockey stick.

3. The invention according to claim 1 wherein said game object comprises a soccer ball and said propelling force is applied by the player's foot.

4. The invention according to claim 1 wherein both said first and second elements are mounted for linear, sliding movement.

5. The invention according to claim 4 wherein said base structure includes a hollow sleeve wherein said first element is mounted for freely sliding movement.

6. The invention according to claim 5 wherein said first element is hollow and said second element is mounted for telescoping, freely sliding movement with respect thereto.

7. The invention according to claim 6 and further including stop means on both said first and second elements for limiting movement thereof between said first and second positions of each.

8. The invention according to claim 7 wherein said first element includes an elongated slot and said element comprises a pin fixedly attached thereto and extending through and movable within said slot, said pin engaging one end of said slot to provide said stop means defining said first position of said second element.

9. The invention according to claim 8 wherein said second member further includes peripheral flange means which engages said first element to provide said stop means defining said second position of said second element.

* * * * *